US005330207A

United States Patent [19]

Mitchell

[11] Patent Number: 5,330,207

[45] Date of Patent: * Jul. 19, 1994

[54] HAND ACTIVATED SKATE BRAKE AND METHOD

[75] Inventor: David N. Mitchell, Englewood, Colo.

[73] Assignee: Out of Line Sports, Inc., Englewood, Colo.

[ * ] Notice: The portion of the term of this patent subsequent to Oct. 19, 2010 has been disclaimed.

[21] Appl. No.: 5,016

[22] Filed: Jan. 15, 1993

Related U.S. Application Data

[63] Continuation of Ser. No. 934,166, Aug. 24, 1992, Pat. No. 5,253,882, which is a continuation-in-part of Ser. No. 830,609, Feb. 4, 1992, Pat. No. 5,211,409.

[51] Int. Cl.[5] ..... A63C 17/14

[52] U.S. Cl. ..... 280/11.2; 280/11.22; 188/5

[58] Field of Search ..... 280/11.19, 11.2, 11.22, 280/11.21, 11.23, 11.24, 11.25, 87.041, 87.042, 87.051, 7.12, 7.13, 8, 9, 10, 612, 842; 188/5, 6, 7, 8

[56] References Cited

U.S. PATENT DOCUMENTS

| | | | |
|---|---|---|---|
| 2,208,888 | 7/1940 | Whited | 280/11.2 |
| 3,112,119 | 11/1963 | Sweet | 280/11.2 |
| 4,033,596 | 7/1977 | Andorsen et al. | 280/11.2 |
| 4,054,296 | 10/1977 | Sullins | 280/11.2 |
| 4,076,266 | 2/1978 | Krausz | 280/11.2 |
| 4,088,334 | 5/1978 | Johnson | 280/11.2 |
| 4,094,524 | 6/1978 | Carroll | 280/11.2 |
| 4,108,451 | 8/1978 | Scheck, Sr. | 280/11.2 |
| 4,167,225 | 9/1979 | Fragoso | 280/11.2 |
| 4,300,781 | 11/1981 | Riggs | 280/11.2 |
| 4,453,726 | 6/1984 | Ziegler | 280/11.2 |
| 4,807,893 | 2/1989 | Huang | 280/11.2 |
| 5,211,409 | 5/1993 | Mitchell et al. | 280/11.2 |

*Primary Examiner*—Richard M. Camby
*Attorney, Agent, or Firm*—Beaton & Swanson

[57] ABSTRACT

A skate brake system includes a carriage that pivots about the rear of a skate so as to bring a brake pad into contact with the skating surface when activated by a hand-activated actuator. The skater need not perform any special body movement to raise (or lower) the toe of the skate, and, accordingly, the angle of the skate relative to the ground remains constant while the brake is applied. In another embodiment, a plunger cannister contains a plunger that brings a brake pad into contact with the skating surface when the plunger is actuated by a hand-activated actuator.

10 Claims, 3 Drawing Sheets

HAND ACTIVATED SKATE BRAKE AND METHOD

This is a continuation of copending application Ser. No. 07/934,166 filed on Aug. 24, 1992, now U.S. Pat. No. 5,253,882 which is, in turn, a continuation in part of application Ser. No. 07/830,609 now U.S. Pat. No. 5,211,439 filed Feb. 4, 1992.

FIELD OF THE INVENTION

This invention relates to roller skate brakes, and more particularly to a roller skate brake which is mechanically activated and stops the skate by applying friction to the ground rather than to a wheel of the skate. The invention has particular utility for use with "inline" skates and other modern skates that attain high speeds and are used in areas with pedestrians, automobiles and other hazards.

BACKGROUND OF THE INVENTION

Traditional roller skates, having sets of wheels in tandem, have long been used in the relatively controlled environment of a skating rink. In a skating rink, the skating surface is typically flat and smooth, skaters travel in the same direction around an oval or circular track, and there are few unexpected hazards. There has been, therefore, little need for an effective brake on a traditional roller skate.

Relatively recently, a faster and more maneuverable type of roller skate has been introduced. These skates, known as "inline" skates because the wheels are mounted in a line rather than in tandem, act much as an ice skate. Inline skates are offered in the United States by several vendors, including Rollerblade, Veraflex, Bauer, California Pro, and Hyper Wheels. Inline skates have appealed to the athletic adult and young adult, and to persons who enjoy the outdoors. Such skates are commonly used outside, on uneven sidewalks, bicycle paths, and roads. Skaters can achieve high speeds and can become a hazard to themselves and others when skating more rapidly than conditions allow. There is a need for an effective brake for inline skating to become a sport that is safe as well as enjoyable.

A brake commonly used on inline skates involves a fixed friction pad that extends behind the heel of the skate. The fixed friction pad is disposed above the skating surface and is made to swing down towards the skating surface by the skater's pivoting the skate about the axis of the rear wheel. As the skater does so, raising the toe of the skate and rotating the heel downward, the friction pad behind the heel will contact the ground and stop the skate. Such systems have also been used on tandem wheeled skates, and, because the speeds are not so high, can involve a fixed friction pad that extends in front of the toe of the skate. In this case, the skater brings the friction pad to bear on the skating surface by raising the heel and lowering the toe.

Examples of these physically activated (toe-raised, or toe-lowered) brakes include those described in U.S. Pat. Nos. 2,901,259 (tandem wheeled skates, brake member in the toe section, braking performed by lowering the toe); 4,313,610 of Volk (a friction-damped wheel in the heel section, braking performed by raising the toe); 4,865,342 of Kong (for a skate board). The adaptation of such a brake for use with an inline skate is shown in U.S. Pat. Nos. 4,394,028 of Wheelwright; 4,418,929 of Gray; 4,909,523 of Olson; 5,052,701 of Olson; and 5,067,736 of Olson.

Disadvantages of the physically activated, toe-raised (or lowered), brakes include these: (a) the braking maneuver requires the exercise of thigh muscle strength, and a skater's fatigue will make the maneuver more difficult to perform, (b) the braking maneuver requires the skater to place himself or herself in an awkward position, and a skater's lack of dexterity or balance will make the maneuver difficult to perform, especially if the skater is moving at relatively high speed or encounters an unexpected hazard, and (c) such brakes can only be used on one skate, effectively halving the potential stopping force available.

It may be said, in general, that an inexperienced skater finds it very intimidating to move his or her foot through such a large arc that he or she must jeopardize their balance in order to apply the brake. This has made many potentially new skaters reluctant to take up the sport at all.

There has been much interest in attempting to solve the problems of toe-raised (or lowered) brakes so as to make inline skating a sport that can be enjoyed by other than the young, the fit, or the reckless. Current attempts to do so have been directed towards replacing the physically-activated brake with a mechanically activated device. There have been attempts to mount a caliper or disc brake adjacent to the side or tread of one of the wheels of the skate. A hand lever-and-cable system can be used by the skater to apply friction pressure to the side or to the tread of the wheel, and the skate can be made to stop without the need for special body movement by a skater.

Examples of these mechanically activated (wheel based) brakes include those described in U.S. Pat. Nos. 4,295,547 of Dungan; 4,312,514 of Horowitz et al.; 4,943,075 of Gates; and 4,943,072 of Henig.

Disadvantages of trying to use the wheel of an inline skate for stopping include these: (a) the amount of contact that a wheel can have with the skating surface is very small when compared to the amount of contact that a friction pad behind the skate could have, (b) because inline skate wheels encounter considerable wear, and the wear is uneven, it is possible that the wheel selected for braking may have little, or no, contact with the ground, (c) heat generated by the rubbing of a brake pad on the wheel may cause the wheel to break down and fall apart, (d) the wheel selected for braking may develop flat spots and cause rough skating, and (e) the replacement cost of a skate wheel is high compared to the cost of replacing a friction pad behind the skate.

Thus, there are two general kinds of brake systems currently available. The first kind of brake stops the skate by using a physical maneuver to bring a pad into contact with the skating surface (toe-raised or toe-lowered brakes). The second kind of brake stops the skate by using a mechanically activated device to bring a pad into contact with a wheel of the skate (wheel-based brakes).

There are also some composite brakes, in which a physical maneuver is used both to bring a pad into contact with the skating surface and to bring another pad into contact with a wheel of the skate. Examples are described in U.S. Pat. No. 4,807,893 of Huang (brake member in the heel section, braking performed by depressing the heel); and in U.S. Pat. No. 4,453,726 of Ziegler. Composite brakes of this kind still fall into the general category of toe-raised or toe-lowered brakes and share all of the previously discussed disadvantages of the physically activated brake.

Despite the work which has been done to develop an optimum inline skate brake, each of the existing brakes has problems. Either they are hard to use (that is, the physically activated, toe-raised or toe-lowered brakes), or they offer relatively small effective stopping force (that is, the mechanically activated, wheel-based brakes). Accordingly, it can be seen that there is a need for an inline skate brake that better meets the needs of a skater.

The desired inline skate brake should have a relatively large effective area in contact with the skating surface so as to maximize the effective stopping power of the brake. In addition, the desired inline skate brake should permit an independent selection of the material for the portion that is in effective contact with the skating surface. That is, this important portion of the brake assembly should be selected without regard to factors other than its effectiveness (durability, coefficient of friction, and so on) for stopping the skate. These concerns suggest that the desired brake will not be a wheel-based brake in which the only area in contact with the ground is the wheel and in which the material in effective contact with the ground must be the same material as is used in the wheel itself.

The desired inline skate brake should be capable of being fitted to both skates, rather to just one skate, so as to double the effective braking surface area in contact with the skating surface. In addition, the desired inline skate brake should use the skater's hand, rather than his or her foot or leg, to activate the movement of the braking pad. Using the hand to activate the brake will allow the skater to use his or her total body, including hands, to maintain good balance at all times, including times when the skater needs to slow down or stop and when the need for balance may be greatest. These concerns suggest that the desired brake will not be a toe-raised or tow-lowered brake.

In addition, the desired inline skate brake should be capable of being retrofitted to most existing skates and should be capable of being installed as original equipment by skate manufacturers at reasonable cost. If the skate brake is mechanically activated, it should have a secondary, or "emergency," brake that can be used in the event of mechanical failure of the primary activator. If a cable-and-hand-lever activator is used, it should have some means for conveniently retaining the cables and hand levers.

It is a specific object of the current invention to provide a brake system that is mechanically activated, that uses the skating surface (rather than a wheel of the skate) for generating stopping force while the angle of the skate relative to the ground remains constant, that has a large effective area in contact with the skating surface, that can be fitted to both skates, that allows for an independent selection of the material in contact with the braking surface, that incorporates an emergency brake, that can be readily installed in new or used skates, and that conveniently retains all cables and hand-levers which are a part of the system. These, and other advantages, of the brake system of this invention will become apparent in the remainder of this disclosure.

U.S. patent application Ser. No. 07/830,609 (of which this is a continuation-in-part) discloses a hand-activated brake system having a rocker arm that accomplishes the foregoing objects. The present invention discloses two other hand-activated brake systems: one that includes a wrap around brake carriage; and another that includes a plunger.

Although this disclosure is directed towards the newer "inline" skates, it should be understood that the brake system of this invention may be readily adapted to the traditional tandem skates, skate boards, ski skates, and to other skating devices.

SUMMARY OF THE INVENTION

In a first embodiment, the skate brake system of this invention includes a carriage that pivots about the rear of a skate so as to bring a brake pad into contact with the skating surface when the carriage is activated. The carriage is hand-activated so that the skater need not perform any special body movement so as to raise (or lower) the toe of the skate. Accordingly, the angle of the skate relative to the ground remains constant while the brake is applied.

In the first embodiment, a U-shaped brake carriage wraps around the heel of a skate, with the heel of the U being oriented to the rear so that a brake pad may be brought into contact with the skating surface behind the skate when the carriage is activated.

The open end of the U-shaped carriage faces towards the front of the skate, and the closed end extends outwards behind the heel of the skate. In a preferred embodiment (for easy retrofit to existing skates) the brake carriage is pivotably connected to the axle of the rear-most wheel of the skate. A pair of holes from one arm to the opposite point on the other arm of the U is adapted so that the brake carriage may be mounted on the axle of the wheel.

A brake pad is mounted on the brake carriage behind the heel of the skate. In a preferred embodiment, the brake pad is contained within the cup of the "U" and is secured by a bolt embedded in the brake pad that is attached by a nut to a mounting piece within the carriage. The pad is further secured to the carriage by a set of complementary nipples and holes disposed in the mounting piece and the brake pad. When the brake is activated, the brake pad will swing down with the brake carriage until the pad hits the ground. When not activated, the brake pad will ride with the brake carriage above the skating surface. The brake pad is formed of a high density molded material having a high coefficient of friction and high durability.

The arms of the brake carriage act as levers about the pivot point. A first force applied to an arm causes the brake carriage to rotate about the axle of the wheel in a counter-clockwise direction and drives the brake pad against the ground. A second force applied to an arm causes the brake carriage to rotate about the axle in a clockwise direction and pulls the brake pad away from the ground. A mechanical advantage may be obtained by mounting a pulley on the axle of the wheel and threading a cable around the pulley.

In a second embodiment, the skate brake system of this invention includes a plunger cannister mounted on a skate and containing a plunger that moves so as to bring the brake pad into contact with the skating surface when the plunger is activated. When the plunger cannister is oriented so that the plunger axis is substantially vertical relative to the skating surface, a brake pad connected to the plunger will contact the skating surface as the plunger is lowered. Thus, in a way analogous to the first embodiment, a first force applied to the plunger lowers it and drives the brake pad against the ground. A second force applied to the plunger lifts it and pulls the brake pad away from the ground.

The brake system of this invention (whether embodied as a carriage or as a plunger) is mechanically activated by hand so that the skater need not perform any special body movement so as to raise (or lower) the toe of the skate. In both embodiments, a cable-and-lever system may be used to provide the first force that drives the brake pad to the ground for stopping, and a spring may be used to provide the second force for holding the brake pad away from the ground for free skating. Where a cable is used, it becomes important to retain the cable, and this invention includes a housing that can be worn by the skater as a belt.

The belt includes elastic retainers that hold the cables, and also VELCRO-brand hook and loop fasteners. The elastic retainers are intended to help guard against the cables' dragging behind the skater if the cables should be dropped. The VELCRO-brand fasteners are intended to be used with complementary fasteners on the hand-operated levers so that the skater may conveniently affix the hand levers to the belt until needed.

The skate brake system of this invention may be used on either skate (left or right). It may also be used on both skates. When affixed to either skate, the skate brake system of this invention provides an effective surface area for the application of stopping force to the ground which is equal to or greater than that of typical toe-raised brakes, and which is substantially greater than typical wheel-based brakes. When affixed to both skates, the skate brake system of this invention can effectively double, or more than double, the stopping surface area of typical toe-raised brakes, and far exceeds the stopping surface area of the typical wheel-based brake.

Additional features of the skate brake system of this invention include an arresting assembly which acts as a secondary, or emergency, brake which can be used if the cable-and-lever actuator fails. The emergency brake includes an arresting bar oriented above the brake carriage in such a way that the system of this invention will lock in place, and may be used as a typical "toe-raised" brake. Other features, advantages, and mechanisms for activating the brake, including a thin wire activator, and a wireless activator that dispenses with cables altogether, and a method of using and installing this brake system, will be described in the detailed discussion that follows.

In summary, the brake system of this invention is mechanically hand-activated, uses the skating surface (rather than a wheel of the skate) for generating stopping force while the angle of the skate relative to the ground remains constant, has a large effective area in contact with the skating surface, can be fitted to both skates, allows for an independent selection of the material in contact with the braking surface, incorporates an emergency brake, can be readily installed in new or used skates, and conveniently retains all cables and hand-levers which are a part of the system. These, and other advantages, of the brake system of this invention will become apparent in the remainder of this disclosure.

DETAILED DESCRIPTION OF THE INVENTION

First Embodiment

Figure 1:
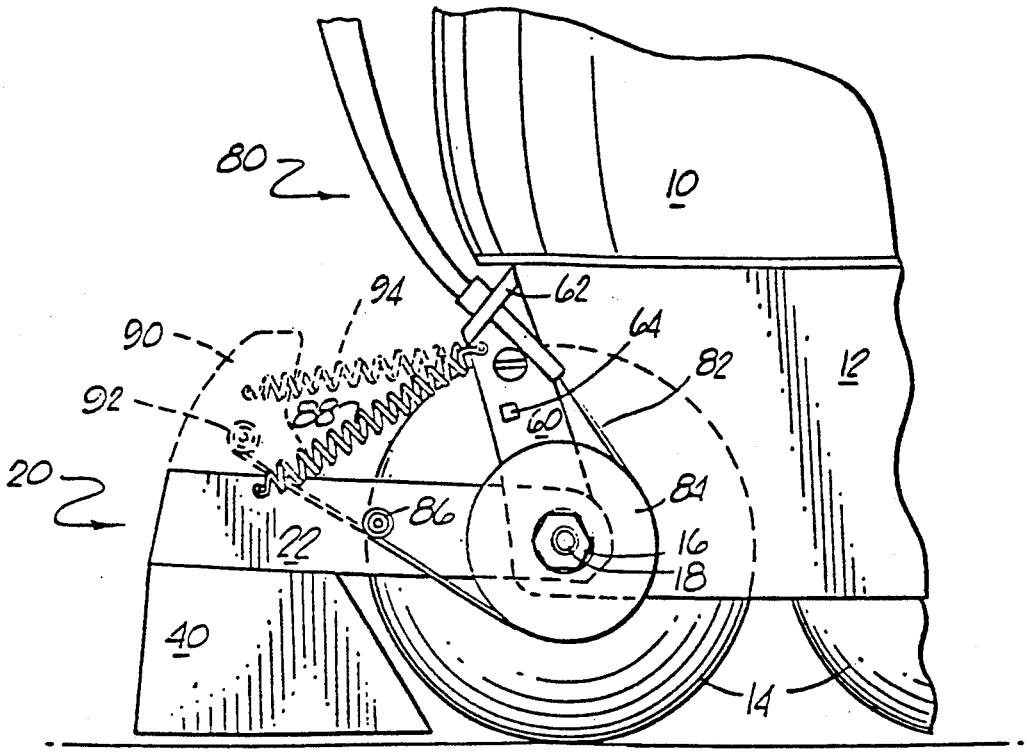
FIG. 1 is a side elevational view of the brake carriage assembly of this invention.

With reference to FIG. 1, it can be seen in overview that a first embodiment of the brake system of this invention includes a brake carriage 20, a brake pad 40, an actuator support arm 60, and an actuator assembly 80. Each of these elements will be discussed individually, before returning to FIG. 1 for a discussion of the elements in combination.

Figure 2:
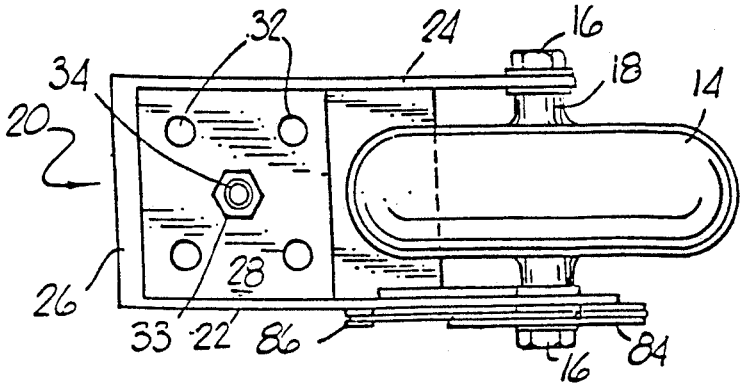
FIG. 2 is a top plan view of the brake carriage assembly of this invention.

Referring to FIG. 2, it can be seen that the brake carriage 20 of this invention is a "U" shaped frame having a first arm 22, a second arm 24, a back frame member 26, and a brake mounting piece 28.

It can be seen that the brake carriage 20 is set behind the skate. In this embodiment, the carriage 20 is oriented so that it may wrap around the back of the skate. The brake carriage 20 is pivotally attached to the axle 18 of a wheel 14 of a skate, and held in place by the axle nuts 16. A pulley 84 is mounted on axle 18, and a retaining pin 86 is mounted on carriage arm 22.

The brake mounting piece 28 of the brake carriage 20 has four holes 32 which serve to retain the brake pad (not shown in FIG. 2). A nut 33 is shown above a hole 34, and serves to affix the brake pad (not shown).

Figure 3:
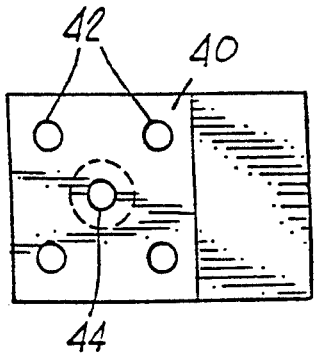
FIG. 3 is a top plan view of a brake pad used in this invention.
Figure 4:
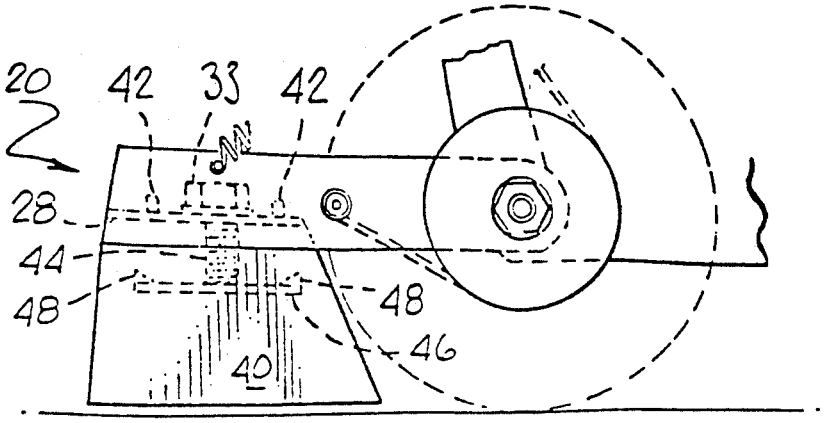
FIG. 4 is a side elevational view of the brake carriage assembly of this invention, showing the brake pad mounted therein.

With reference to FIG. 3, it can be seen that the brake pad 40 has four nipples 42 protruding from its top surface, and has an embedded bolt 44. Looking at FIG. 4, it can be understood that the brake pad 40 fits securely into the brake carriage 20 within the cup formed at the base of the "U". It can be seen that the embedded bolt 44 of the brake pad 40 passes through the hole 34 (not separately numbered in FIG. 4) of the brake mounting piece 28 and is attached to the mounting piece 28 by bolt 33. The nipples 42 of the brake pad 40 pass through the holes 32 (not separately numbered in FIG. 4) of the brake mounting piece 28 and further secure the brake pad 40 in place. In FIG. 4, it may also be seen that the embedded bolt 44 of the brake pad has a head 46 having flanges 48. The flanges 48 serve to secure the bolt 44 within the brake pad 40.

Returning to FIG. 1, it can now be seen that the brake carriage 20 is pivotably attached behind the heel of an inline skate boot 10. A typical inline skate, as shown in FIG. 1, includes a skate boot 10 having a wheel housing 12 in which several wheels 14 are mounted. Each wheel 14 is affixed by a nut 16 to an axle 18. The brake carriage 20 pivots about the axle 18 of the rearmost wheel 14.

The brake carriage 20 carries the brake pad 40, and the brake carriage 20 is slipped onto the axle 18 of the wheel 14 over the actuator support arm 60. The brake carriage 20 is operatively connected to the actuator assembly 80. In this embodiment, the actuator assembly includes a cable 82 having a linkage carried in an actuator housing 62 of the actuator support arm 60, and a pulley 84 mounted on the axle 18.

Arm 22 of the brake carriage 20 is connected to cable 82 of the actuator assembly 80 at retaining pin 86. Retaining pin 86 is located along the arm as shown. Cable 82 runs from the retaining pin, around pulley 84, and to the linkage carried in actuator housing 62.

It can be understood that, when the actuator assembly 80 is engaged so as to pull the cable 82 towards the actuator housing 62, the resultant force will pull the carriage arm 22 towards the periphery of pulley 84. This, in turn, will cause the brake carriage assembly 20 to rotate in a counter-clockwise direction about the pivot axle 18 of the rearmost wheel 14. This rotation will urge the brake pad 40 towards the ground where it will engage the skating surface to stop the skate.

A tension spring 88 is attached, at one end, to arm 22 of the brake carriage and, at the other end, near actuator housing 62 of the actuator support arm 60. Thus, when the cable 82 is not engaged, the spring tension will pull carriage arm 22 towards actuator housing 62. This, in turn, will cause the brake carriage assembly 20 to rotate in a clockwise direction about the pivot axle 18 of the rearmost wheel 14. This rotation will urge the brake pad 40 away from the ground where it will ride until activated by the actuator assembly 80.

It should be readily understood that the responsiveness of the brake system is influenced by the location of retaining point 86 on the arm in relation to pivot axle 18, which is the pivot point about which the arm rotates. If desired, the responsiveness of the brake system may be further influenced by fixing a retaining pin even further away from pivot axle 18. As will be described below, one way to do so is by using a separate mounting assembly to extend the retaining pin beyond arm 22.

Shown in phantom in FIG. 1 is a mounting assembly 90 set on top of carriage 20. It can be understood that retaining pin 86 could be removed and that cable 82 could be extended so as to reach the mounting assembly. With reference to the phantomed structure shown in FIG. 1, it may be seen that the cable could be secured to mounting assembly 90 at a retaining pin 92, and a tension spring 94 could be set between the mounting assembly 90 and actuator support arm 60. By adjusting the location of the retaining pin in relation to the axis of rotation 18, including placement of the retaining pin above the brake carriage, the retaining pin is extended beyond arm 22 and the responsiveness of the brake system may be tuned as desired.

The arresting arm 64 of the actuator support arm 60 can now be understood to operate as an emergency brake. In the event that some component of the actuator assembly 80 should fail, the system of this invention uses the arresting arm 64 to simulate the working of a traditional toe-raised brake. It can be seen that the arresting arm 64 extends outward from the actuator support arm 60. In an emergency situation, the skater may lift the toe of the skate, bringing the brake pad 40 into contact with the ground. This maneuver is performed by the skater pivoting rearwardly about the axis of the rear skate wheel and swinging the skate from the normal coasting position to a braking position where the brake pad 40 drags against the ground. Although carriage arm 22 of the brake carriage 20 will pivot, the arresting arm 64 will limit the arcuate range of rotation, and will lock the rocker arm in place at the limit of rotation. Locked into place, the rocker arm 22 holds the brake pad 40 against the skating surface so that the brake pad will drag against the ground and bring the skater to a stop.

Finally, although the brake system as shown discloses an actuator assembly that includes a pulley 84 to obtain a mechanical advantage, it should be understood that the brake system of this invention may be operated with any number of well known equivalent structures, all serving to transmit force to carriage 20 so as to rotate the carriage about a pivot axis.

Figure 5:
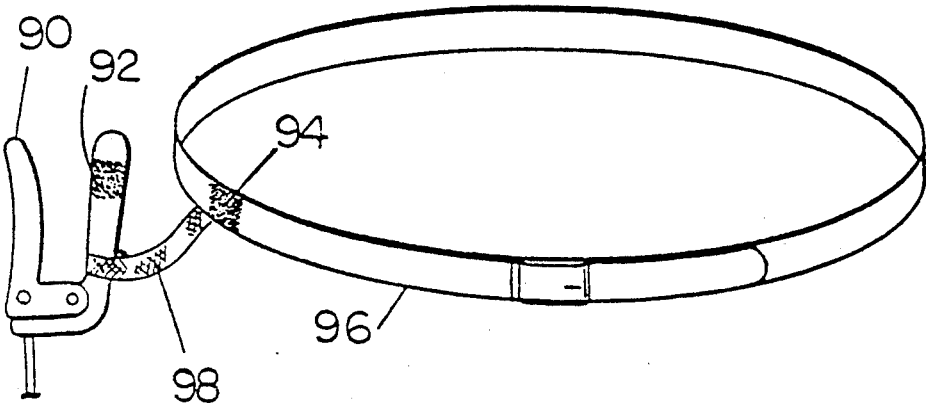
FIG. 5 is a perspective view of a belt for housing the hand-held controller(s) used to activate the brake system of this invention.

The actuator assembly is activated by a hand-held controller 90 (reference FIG. 5). To better accommodate the needs of a skater, this invention includes a VELCRO-brand hook and loop fastener 92 affixed to the controller 90, and a corresponding VELCRO-brand hook and loop fastener 94 which is placed on a belt 96. It can be seen that the skater may, when not holding the controller 90, readily place it on the belt 96 by the VELCRO-brand hook and loop fastenings.

For further convenience, and safety, the controller 90 is attached to the belt 96 by a strap 98. Strap 98 is designed to aid the skater in the event that the skater should drop the controller 90. Instead of dragging behind the skater on the ground, the controller 90 is retained by strap 98. The strap 98 may be made of elastic material in order that it may be relatively short (so that the controller 90 will be within reach if dropped) but also able to travel at arm's length (so that the skater will be able to hold the controller 90 at a comfortable distance from the body).

Materials and dimensions suitable for producing this embodiment of the brake system of this invention include these:

The brake carriage 20, as shown in FIG. 2, may be of cast steel, aluminum, or a high density polymer; the back frame member 26 is about 2.0 inches in length; carriage arms 22 and 24 are about 3.0 inches in length.

The brake pad 40 may be molded polyurethane, and dimensioned so that the bottom surface is about 1.5 inches by about 2.25 inches so as to provide a stopping surface of about 3.375 square inches. The embedded bolt 44 may be 0.25 inch-20 having 1.0 inch length with a 31/32 inch bolt head.

The actuator assembly 80 may include a cable housing having an outer diameter of about 5.0 mm, and an inner diameter of about 2.0 mm. The cable housing may be of coiled steel with vinyl covering and a TEFLON liner. The cable 82 has a diameter of slightly less than 2.0 mm and may be made of wound steel.

Second Embodiment

Figure 6:
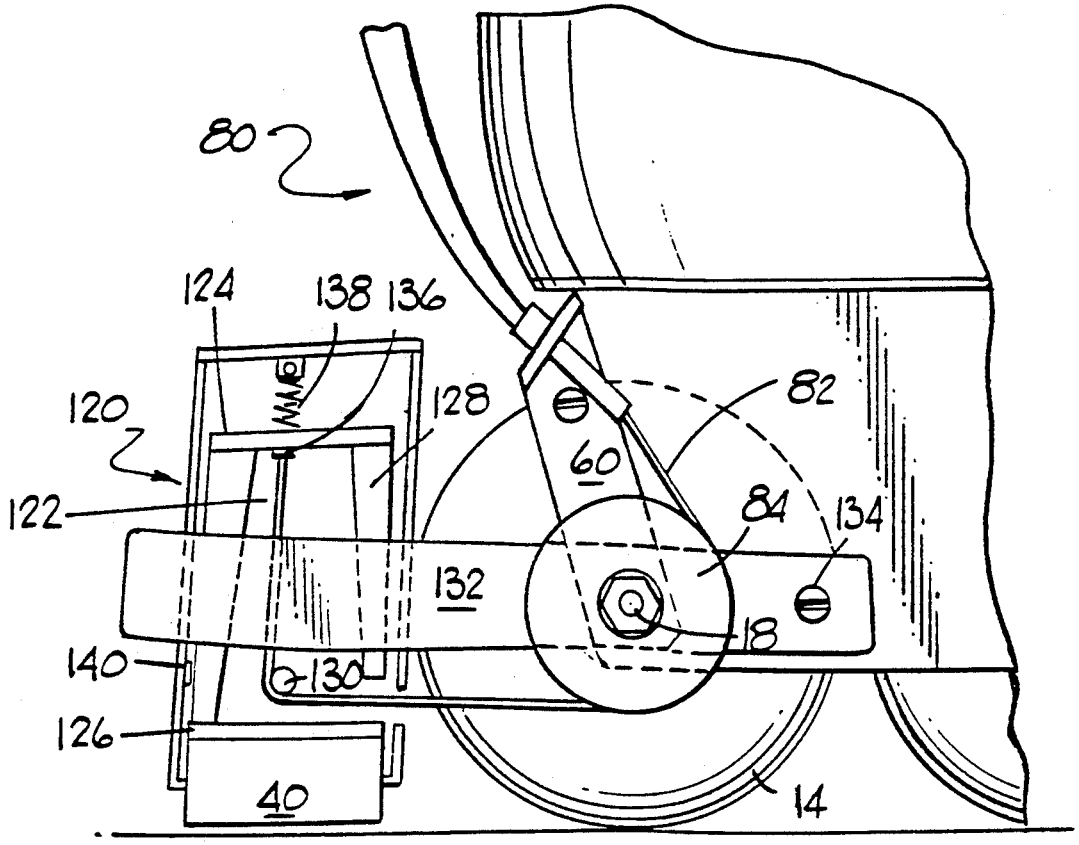
FIG. 6 is a side elevational, partially cut away view of the plunger cannister system of this invention.

With reference to FIG. 6, it can be seen in overview that a second embodiment of the brake system of this invention includes a plunger cannister 120, a brake pad 40, an actuator support arm 60, and an actuator assembly 80 (for ease of reference, structures which are common to the first and second embodiment will be designated with identical numerals). Moreover, many of the workings of the second embodiment are the same as the first embodiment and will not be repeated here in detail.

The plunger cannister 120 houses a plunger 122 having a top surface 124 and a bottom surface 126 joined together by a plunger wall 128. In a preferred embodiment, plunger 122 is channelled and hollowed in order to accommodate cable 82 and pulley 130 in the interior of the plunger, but it should be understood that the plunger may be constructed many other ways, including by fabricating an open frame that joins the top and bottom surfaces.

The plunger cannister is mounted to the rear of the skate and is oriented so that the plunger axis is vertical relative to the skating surface. In this embodiment, the cannister 120 is mounted to a support 132 which wraps around the rear of the skate. Support 132 is secured to the skate at the axle 18 of the rearmost wheel 14, and is further secured by bolt 134.

The brake pad 40 is fixed to the bottom surface 126 of plunger 122. The bottom surface 126 works as does the brake mounting plate 28 already discussed with reference to the first embodiment. Bottom surface 126 and brake pad 40 may include the bolt, nipples, holes and other structures previously discussed, with such adaptations as would be easily understood by one skilled in the art to secure the attachment of brake pad to bottom surface of the plunger.

The plunger cannister 120 is operatively connected to the actuator assembly 80. In this embodiment, the actuator assembly includes a cable 82 having a linkage carried in an actuator housing 62 of the actuator support arm 60, and a pulley 84 mounted on the axle 18.

Plunger 122 is connected to cable 82 of the actuator assembly 80 at retaining pin 136. Cable 82 runs from the retaining pin, around pulleys 130 and 84, and to the linkage carried in actuator housing 62.

It can be understood that, when the actuator assembly 80 is engaged so as to pull the cable 82 towards the actuator housing 62, the resultant force will pull the plunger 122 downwards towards the skating surface. This movement will urge the brake pad 40 towards the ground where it will engage the skating surface to stop the skate.

A tension spring 138 is attached, at one end, to the top surface 124 of the plunger and, at the other end, to the plunger cannister 120 near the top of the cannister. Thus, when the cable 82 is not engaged, the spring tension will pull the plunger upwards. This tension will urge the brake pad 40 away from the ground where it will ride until activated by the actuator assembly 80.

An arresting bead 140 within the plunger cannister 120 can now be understood to operate as an emergency brake. In the event that some component of the actuator assembly 80 should fail, the system of this invention uses the arresting bead 140 to simulate the working of a traditional toe-raised brake. It can be seen that the arresting bead 140 extends inward from the interior wall of the cannister 120.

In an emergency situation, the skater may lift the toe of the skate, bringing the brake pad 40 into contact with the ground. This maneuver is performed by the skater pivoting rearwardly about the axis of the rear skate wheel and swinging the skate from the normal coasting position to a braking position where the brake pad 40 drags against the ground. Although plunger 122 will be pushed upwards, the arresting bead 140 will contact the outer lip of the bottom surface 126 of the plunger so as to limit the range of movement, and will lock the plunger in place at the limit of movement. Locked into place, the cannister 120 holds the brake pad 40 against the skating surface so that the brake pad will drag against the ground and bring the skater to a stop.

The plunger cannister and plunger assembly just described use a direct pull to bring the plunger down towards the skating surface. It should be readily understood that other, equivalent mechanisms may also be used, including mechanisms using levers and like devices to gain a further mechanical advantage.

Method of Use

The method of use of the brake system of this invention will now be explained. The method includes using a brake carriage or plunger to stop the skate, with the carriage or plunger being hand-activated by a mechanical device so as to bring a brake pad that is operatively connected to the carriage or plunger into contact with the skating surface. This method permits the skater to activate the brake without changing the angle of the skate itself relative to the ground—that is, the skater need not lift or lower the heel or toe of the skate. This method also permits the brake pad to contact the skating surface rather than the wheel of the skate.

The method of this invention further includes the option of using two brakes, one on each skate, and includes using hook and loop devices, and straps, to secure the hand controls needed to activate the brake. An emergency braking method involves lifting the toe of the skate, using an arresting bar to lock the carriage, or an arresting bead to lock the plunger, so that the skate may then be stopped like a traditional toe-raised brake. All of the various components necessary to carry out this method have already been explained.

The system of this invention also includes a method for retrofitting the brake to an existing skate. This retrofit method includes removing the axle bolts from the rear wheel of an existing skate; placing the pivot point of a brake carriage, or a plunger cannister support, over the axle; and then replacing the axle bolts so as to secure the structure in place. Optionally, an actuator support arm, or equivalent activating structure, may also be secured to the existing skate.

The foregoing description is addressed to two preferred embodiments. It should be apparent to one skilled in the art that numerous changes and adaptations may be made.

It should also be apparent that the actuator need not be a cable-and-lever device. Because the cable can be seen as a drawback, it might be replaced by (a) a wireless electromechanical actuator, (b) a thin-wire electromechanical actuator.

In the wireless form (not separately shown), a radio-controlled method of activation is used. With reference to FIGS. 1 and 6, it may be understood that a signal may be sent to a solenoid carried at the actuator housing 62 to activate the cable 82. A transmitter may be carried in the skater's hand or on the waist with a battery pack attached to the skate, and the signal to activate the solenoid is sent from the transmitter. The solenoid (and equivalent wireless controllers) is well known to persons skilled in the art, and will not be further described here.

Finally, in the thin-wire form (not separately shown), a transmitter and power source are attached to the skater's waist and a wire runs from the power source to a servomechanism on the skate which activates the cable 82.

In summary, the brake system of this invention is mechanically activated, uses the skating surface (rather than a wheel of the skate) for generating stopping force while the angle of the skate relative to the ground remains constant, has a large effective area in contact with the skating surface, can be fitted to both skates, allows for an independent selection of the material in contact with the braking surface, incorporates an emergency brake, can be readily installed in new or used skates, and conveniently retains all cables and hand-levers which are a part of the system.

What is claimed is:

1. A roller skate brake system, comprising:

(a) a brake carriage having a first arm, a second arm, and a back member connecting said first arm and said second arm, the first arm having a pivot point, and the second arm having a pivot point opposite the pivot point of the first arm, said carriage being rotatably connected at said pivot points to a roller skate with the back member oriented towards the rear of the skate, the carriage riding on said skate above a skating surface when the skate is being used to skate on said surface and said carriage being oriented so that a line drawn between the pivot points is substantially parallel to an axle of the skate; a rotation of said carriage in a first direction about said pivot points urging said back member towards the skating surface, and a rotation of the carriage in a second direction about the pivot points urging said back member away from the skating surface, (b) a brake pad operatively connected to said back member so as to move towards and away from said skating surface in concert with said back member, (c) hand-activated actuator means operatively connected to the carriage, said actuator means urging the carriage to rotate in said first direction so that the brake pad is urged towards said skating surface when the actuator is engaged and;

(d) return means operatively connected to said carriage, said return means urging the carriage to rotate in said second direction so that the brake pad is urged away from the skating surface when the actuator is not engaged, said brake system thereby using the skating surface for stopping said skate when the actuator is engaged and while the angle of the skate relative to the ground remains constant.

2. The system of claim 1, wherein said pivot points are connected to said skate near the rearmost wheel of the skate, being within about 4.0 inches of the axle of the rearmost wheel of said skate.

3. The system of claim 1, wherein said actuator means comprises a wireless electromechanical device operatively connected to said carriage, and a hand operated electronic controller in wireless communication therewith for engaging and disengaging said actuator.

4. The system of claim 1, further comprising arresting means for stopping said skate in the event of a failure of the actuator, said arresting means including an arresting bar operatively connected to the skate and disposed within the arcuate path of said carriage, said arresting bar restricting the arcuate range of motion of the carriage and arresting the rotation of the carriage at a limit of said range thereby locking said carriage in place at said limit.

5. The system of claim 1, wherein said brake pad has an embedded bolt affixed thereto with an end of said bolt extending outwards from said pad, and said carriage has a brake mounting plate attached thereto, said brake mounting plate having a hole adapted to receive said bolt for attaching the brake pad to said brake mounting plate.

6. The system of claim 5, wherein one of said brake pad and said brake mounting plate has a plurality of nipples and the other of said brake pad and brake mounting plate has a plurality of mating holes for seating said brake pad in said brake mounting plate.

7. An assembly for use in a roller skate brake system, said assembly comprising carriage means including a braking surface, a left side pivot point and a right side pivot point, said carriage means being rotatably connected at said pivot points to a roller skate, the carriage riding on said skate above a skating surface when the skate is being used to skate on said skating surface and said carriage means being oriented so that a line drawn between the pivot points is substantially parallel to an axle of the skate; a rotation of said carriage means in a first direction about said pivot points urging said braking surface towards the skating surface and a rotation of the carriage means in a second direction about the pivot points urging said braking surface away from the skating surface, said brake system having an actuator for rotating the carriage means in said first direction, thereby using the skating surface for stopping while maintaining a constant angle of the skate relative to the skating surface as the carriage means rotates, said roller skate being attachable to a skater's foot so that the foot is firmly held within the skate and is substantially fixed relative to said carriage means.

8. A method for stopping a pair of roller skates, comprising the steps of:

(a) attaching carriage means including two pivot points to a first skate, said carriage means having a brake pad operatively connected thereto and said carriage means being rotatably connected at said pivot points to said skate and being oriented so that a line drawn between the pivot points is substantially parallel to an axle of said skate, said first skate being attachable to a skater's first foot so that the foot is firmly held within the skate and is substantially fixed relative to said carriage means, and (b) rotating said carriage means while skating, thereby bringing said brake pad into contact with the skating surface while the angle of said first skate relative to the skating surface remains constant.

9. The method of claim 8, further comprising the step of rotating a second carriage means that is pivotally attached to a second skate, said carriage means having a brake pad operatively connected thereto, said brake pad being brought into contact with a skating surface when rotated, thereby bringing said brake pad into contact with the skating surface while the angle of said second skate relative to the skating surface remains constant, said second skate being attachable to a skater's second foot so that the foot is firmly held within the skate and is substantially fixed relative to said carriage means.

10. The method of claim 8, wherein said attaching step further comprises the step of rotatably connecting said carriage means to an axle of said skate.

* * * * *